US009562394B2

(12) United States Patent
Gibb et al.

(10) Patent No.: US 9,562,394 B2
(45) Date of Patent: Feb. 7, 2017

(54) TIMED IMPACT DRILL BIT STEERING

(75) Inventors: John C. Gibb, Kuala Lumpur (MY); Malcolm Upshall, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 481 days.

(21) Appl. No.: 12/967,691

(22) Filed: Dec. 14, 2010

(65) Prior Publication Data

US 2011/0155467 A1 Jun. 30, 2011

(30) Foreign Application Priority Data

Dec. 28, 2009 (WO) ..... PCT/US2009/069609

(51) Int. Cl.
*E21B 7/06* (2006.01)
*E21B 6/00* (2006.01)

(52) U.S. Cl.
CPC .. *E21B 7/06* (2013.01); *E21B 6/00* (2013.01)

(58) Field of Classification Search
CPC ..... E21B 4/14; E21B 4/12
USPC ..... 175/27, 61, 73, 415
See application file for complete search history.

(56) References Cited

U.S. PATENT DOCUMENTS 3,924,690 A * 12/1975 Shaw ..... 173/13
3,946,819 A 3/1976 Hipp
4,144,941 A 3/1979 Ritter
4,632,191 A 12/1986 McDonald et al.
4,694,913 A 9/1987 McDonald et al.
4,862,958 A 9/1989 Pringle
4,862,976 A 9/1989 Meek
4,867,255 A 9/1989 Baker et al.
4,907,658 A 3/1990 Stangl et al.
5,156,223 A 10/1992 Hipp
5,396,965 A 3/1995 Hall et al.
5,421,420 A 6/1995 Malone et al.
5,449,046 A 9/1995 Kinnan
5,602,541 A * 2/1997 Comeau et al. ..... 340/853.3
5,638,910 A * 6/1997 Noe et al. ..... 175/73
(Continued)

FOREIGN PATENT DOCUMENTS

EP 0467642 A2 * 7/1991
EP 0467642 A2 1/1992

OTHER PUBLICATIONS

International Search Report and Written Opinion issued Jan. 27, 2011, for International Patent Application No. PCT/US10/028498, 10 pages.

(Continued)

*Primary Examiner* — David Andrews
(74) *Attorney, Agent, or Firm* — Chamberlain Hrdlicka

(57) ABSTRACT

A method of steering a drill bit while drilling a wellbore can include periodically delivering an impact to the drill bit as the drill bit is rotated by a drill string. The impact may be delivered to the drill bit when an axis of the drill bit is oriented in a desired azimuthal direction relative to an axis of the drill string. Another method of steering a drill bit while drilling a wellbore may include interconnecting a bend in a drill string between an impact tool and the drill bit, and periodically delivering an impact from the impact tool to the drill bit as the drill bit is rotated by the drill string. A directional drilling system can include a drill string having a bend interconnected therein, an impact tool, and a drill bit, the bend being interconnected in the drill string between the drill bit and the impact tool.

25 Claims, 4 Drawing Sheets

(56) References Cited

U.S. PATENT DOCUMENTS

| | | | | |
|---|---|---|---|---|
| 6,012,536 | A | 1/2000 | Puttmann et al. | |
| 6,109,355 | A | 8/2000 | Reid | |
| 6,315,063 | B1 | 11/2001 | Martini | |
| 6,347,675 | B1 | 2/2002 | Kolle | |
| 6,390,207 | B2 | 5/2002 | Wentworth et al. | |
| 6,533,052 | B2 | 3/2003 | Wentworth et al. | |
| 6,536,539 | B2 | 3/2003 | Merecka et al. | |
| 6,554,083 | B1 | 4/2003 | Kerstetter | |
| 6,609,577 | B2 | 8/2003 | Beccu | |
| 6,659,202 | B2 | 12/2003 | Runquist et al. | |
| 6,742,609 | B2 | 6/2004 | Gillis et al. | |
| 6,986,394 | B2 | 1/2006 | Marsh | |
| 7,073,610 | B2 | 7/2006 | Susman | |
| 7,240,744 | B1 | 7/2007 | Kemick | |
| 2002/0084109 | A1 | 7/2002 | Runquist et al. | |
| 2002/0088648 | A1 | 7/2002 | Krueger et al. | |
| 2002/0166700 | A1 | 11/2002 | Gillis et al. | |
| 2002/0185312 | A1 | 12/2002 | Armell et al. | |
| 2003/0024739 | A1 | 2/2003 | Runquist et al. | |
| 2007/0137897 | A1 | 6/2007 | Sanders et al. | |
| 2008/0061621 | A1 | 3/2008 | Leon et al. | |
| 2009/0057018 | A1 | 3/2009 | Farley | |
| 2009/0194334 | A1 | 8/2009 | Johnson et al. | |
| 2009/0260884 | A1 | 10/2009 | Sanelmann | |
| 2010/0032209 | A1 | 2/2010 | Rainey et al. | |
| 2010/0163308 | A1* | 7/2010 | Farley et al. | 175/45 |

OTHER PUBLICATIONS

International Search Report and Written Opinion issued Mar. 14, 2011, for International Patent Application No. PCT/US10/028570, 10 pages.

Drilling Contractor, "Rotary Steerable", product brochure, dated Mar./Apr. 2008, 6 pages.

Halliburton, "Geo-Pilot GXT Rotary Steerable System", H05573, Dated May 2009, 2 pages.

Society of Petroleum Engineers, "Case History: A Robust Point-the-Bit Rotary Steerable System with At-Bit Imaging and 3D Geosteering Service Intergral to Optimal Wellbore Placement in a Complex Thin Sand Reservoir", Presentation Paper SPE 121186, dated Jun. 8-11, 2009, 12 pages.

Novatek, "Nova Drill: Advanced Drilling Technology", product manual, dated May 2008, 54 Pages.

Gang Han and Mike Bruno, Percussion Drilling: From Lab Tests to Dynamic Modeling, International Oil & Gas Conference and exhibition in China, Abstract, Paper No. 104178-MS, dated Dec. 5-7, 2006, 1 page.

Gang Han, Mike Bruno and Maurice B. Dusseault, Dynamically Modelling Rock Failure in Percussion Drilling, ARMA/USRMS 05-819, dated Jun. 25-29, 2005, 7 pages.

International Search Report and Written Opinion issued Sep. 28, 2010, for International Patent Application No. PCT/US09/069609, 11 pages.

Linda Hsieh, Rotary Steerable: Advances Puch Reliability, Application, Performance Up Another Level, Drilling Contractor article, dated Mar./Apr. 2008, 6 pages.

Halliburton, Geo-Pilot® Rotary Steerable System, Sperry Drilling Services, H03973, dated Oct. 2007, 4 pages.

Halliburton, Geo-Pilot® GXT Rotary Steerable System: Taking the drilling Performance to the Next Level, Sperry Drilling Services, H05573, dated May 2009, 2 pages.

Keng H. Kok, Huw Hughes-Jones, Ernie Chavez, Khairul Azmee Abdul Aziz, Khazimad Yusof, Makr Lambert; Case History: A Robust Point-the-Bit Rotary Steerable System with At-Bit Imaging and 3D Geosteering Service Integral to Optimal Wellbore Placement in a Complex Thin Sand Reservoir, SPE 121186, dated Jun. 8-11, 2009, 12 pages.

Novatek International, Inc., Nova Drill: Advanced Drilling Technology, dated May 2008, 54 pages.

Ritchie Wiki, Rotary-Percussion Drill, online encyclopedia, dated Oct. 16, 2009, 3 pages.

Office Action issued Sep. 13, 2013 for U.S. Appl. No. 13/052,245, 16 pages.

Office Action issued Jun. 19, 2013 for U.S. Appl. No. 13/052,245, 14 pages.

Advisory Action issued Nov. 8, 2013 for U.S. Appl. No. 13/052,245, 3 pages.

Office Action issued Oct. 15, 2013 for U.S. Appl. No. 12/960,087, 25 pages.

JA Oilfield Manufacturing, Inc., "Shock Sub System", product information and specifications dated 2006, retrieved from website http://www.jaoilfield.com/ShockSub.html, 2 pages.

Ulterra, "TorkBuster®", product description from web page, on information and belief, this publication existed prior to the filing of the present application, 1 page.

Office Action issued Nov. 26, 2013 for U.S. Appl. No. 13/052,245, 9 pages.

* cited by examiner

TIMED IMPACT DRILL BIT STEERING

BACKGROUND

The present disclosure relates generally to equipment utilized and operations performed in conjunction with a subterranean well and, in an embodiment described herein, more particularly provides for timed impact drill bit steering.

It is frequently desirable to drill a wellbore in a selected direction, for example, to steer toward a hydrocarbon reservoir, or to steer away from a fault or a water zone (although in some circumstances, such as geothermal and conformance operations, it may be desirable to steer toward a fault or water zone). Therefore, it will be appreciated that improvements are needed in the art of steering a drill bit to thereby drill a wellbore in a desired direction.

DETAILED DESCRIPTION

Figure 1:
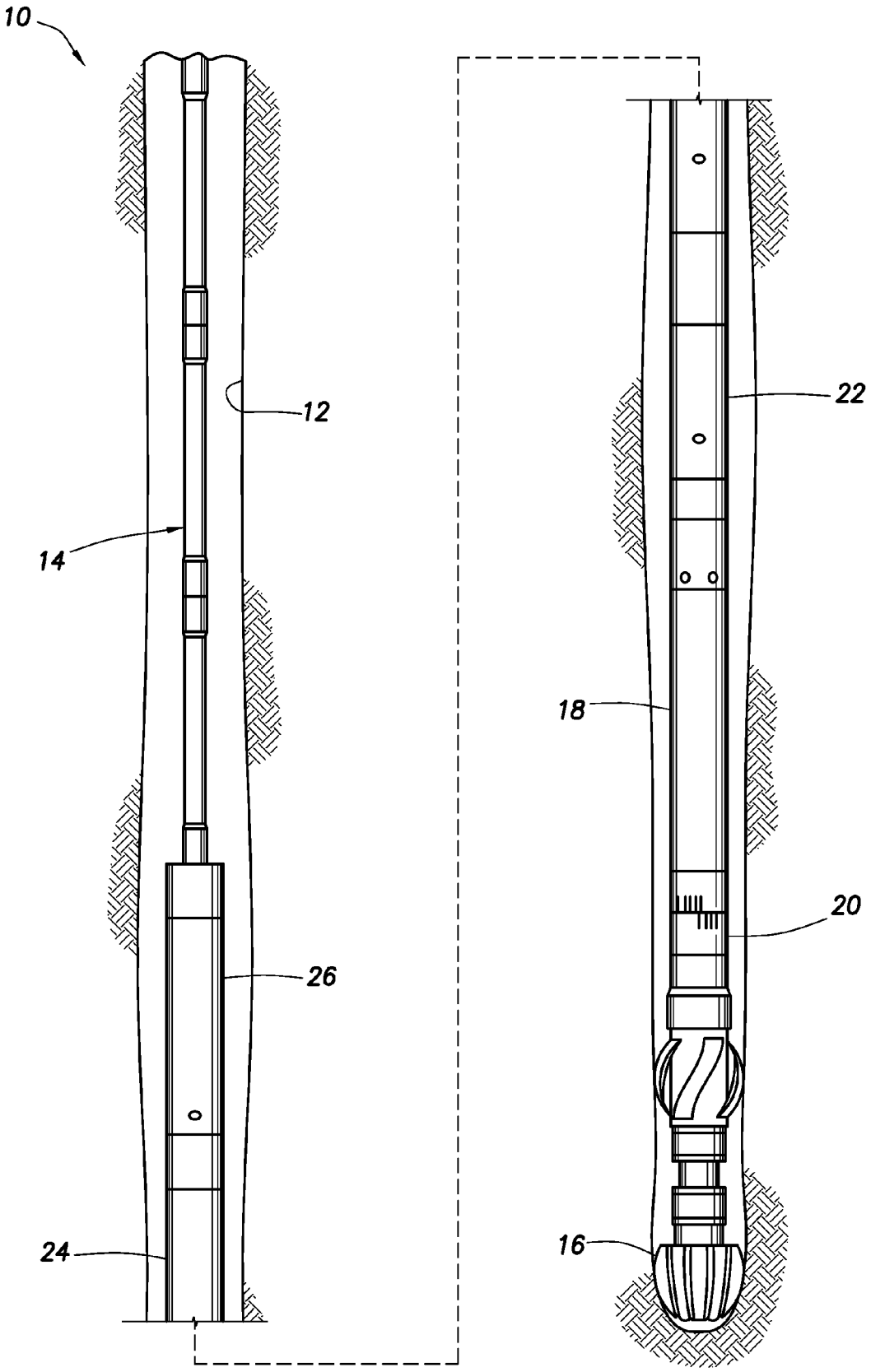
FIG. 1 is a schematic view of a directional drilling system and associated method which may embody principles of the present disclosure.

Representatively illustrated in FIG. 1 is a directional drilling system 10 and associated method which can embody principles of the present disclosure. It should be clearly understood, however, that the principles of this disclosure are not limited at all to the specific details of the system 10 and method described herein. Instead, the system 10 and method are provided as merely one example of how the principles of this disclosure can be effectively used for steering a drill bit, and for thereby drilling a wellbore in a desired direction.

As depicted in FIG. 1, a wellbore 12 is being drilled with a generally tubular drill string 14. A drill bit 16 is connected at a lower end of the drill string 14. Rotation of the drill string 14 (e.g., by a drilling rig at or near the earth's surface) also rotates the drill bit 16, whereby the drill bit cuts into the earth to drill the wellbore 12.

A mud motor 18 is also preferably interconnected as part of the drill string 14. The mud motor 18 is of the type well known to those skilled in the art, which rotates the drill bit 16 in response to flow of drilling fluid through the drill string 14. Thus, the mud motor 18 can be used to rotate the drill bit 16 even if the drill string 14 above the mud motor is not rotated.

A bend 20 is also interconnected in the drill string 14. Although not perceptible in FIG. 1, the bend 20 provides a small (e.g., approximately 1.5 degree) deviation in a longitudinal axis of the drill string 14. The bend 20 is of the type well known to those skilled in the art, which is typically used for directional drilling when a mud motor (such as the mud motor 18) rotates a drill bit (such as the drill bit 16).

Indeed, the bend 20 can be used for steering the drill bit 16 in the system 10 when the mud motor 18 rotates the drill bit (e.g., when the drill string 14 is not rotated from the surface). However, this disclosure provides for steering the drill bit 16 when the drill string 14 is rotated and the mud motor 18 is not used for rotating the drill bit in response to flow of drilling fluid through the mud motor.

Interconnected in the drill string 14 above the mud motor 18 is an impact tool 22. The impact tool 22 delivers timed periodic impacts to the drill bit 16 as described more fully below. The timing of the impacts is controlled by a controller 24, which is in communication with a sensor assembly 26, and which can be remotely operable (e.g., from the surface) via various forms of wired and wireless telemetry.

The sensor assembly 26 can be of the type well known to those skilled in the art as a measurement while drilling (MWD) system. Such MWD systems are capable of measuring a multitude of drilling parameters, and in this system 10 the sensor assembly 26 is beneficially capable of detecting an orientation of the drill string 14 and an azimuthal direction of the drill bit 16 relative to the longitudinal axis of the drill string above the bend 20.

Figure 2:
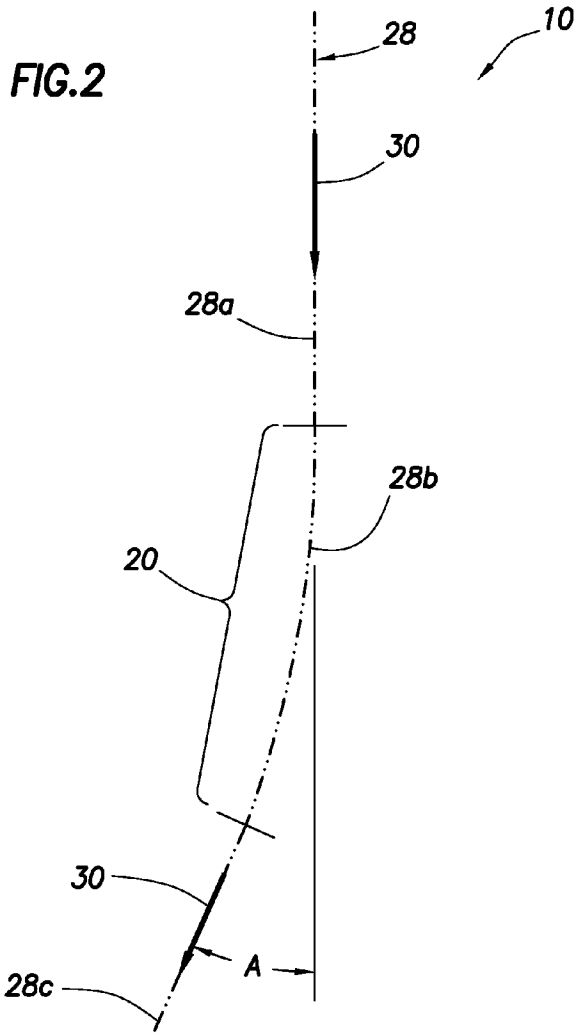
FIG. 2 is a schematic depiction of relative relationships of axes of a drill string in the system and method of FIG. 1.

Referring additionally now to FIG. 2, a schematic depiction of the longitudinal axis 28 of the drill string 14 is representatively illustrated. The bend 20 in the drill string 14 is exaggerated in FIG. 2 for illustrative purposes.

The longitudinal axis 28 of the drill string 14 above the bend 20 is designated as 28*a*, the longitudinal axis of the drill string at the bend is designated as 28*b*, and the longitudinal axis of the drill string below the bend is designated as 28*c* in FIG. 2. Note that the longitudinal axis 28*c* of the drill string 14 below the bend 20 coincides with the longitudinal axis of the drill bit 16.

It will be appreciated that the axis 28*c* of the drill bit 16 deviates from the longitudinal axis 28*a* of the drill string 14 above the bend 20 by an angle A. This angle A may be relatively small, but when compounded over distances of, for example, a hundred meters or more, can produce a much larger change in direction of the wellbore 12.

Note that, although the axis 28*a* is depicted in FIG. 2 as being vertical, the axis 28*a* is described herein as being "above" the bend 20, and the axis 28*c* is described herein as being "below" the bend, it is not necessary in keeping with the principles of this disclosure for the axis 28*a* to be vertical, since the axis 28*a* could be generally horizontal, deviated, inclined relative to vertical, etc. The terms "above," "below" and similar directional terms are used for convenience to refer to positions relative to proximal and distal ends of the drill string 14. For example, the axis 28*a* is "above" the bend 20, in that it is nearer the proximal end of the drill string 14 (e.g., closer to the surface), and the axis 28*c* is "below" the bend, in that it is nearer the distal end (in this case, the bottom end) of the drill string (e.g., farther from the surface).

The impact tool 22 is used to deliver an impact (represented by arrows 30 in FIG. 2) directed along the longitudinal axis 28 of the drill string 14. Due to the bend 20 in the drill string 14, the impact 30 is directed both along the axis 28*a* of the drill string 14 above the bend 20, and along the axis 28*c* of the drill string and drill bit 16 below the bend. This arrangement provides advantages to the system 10 as described more fully below.

Figure 3:
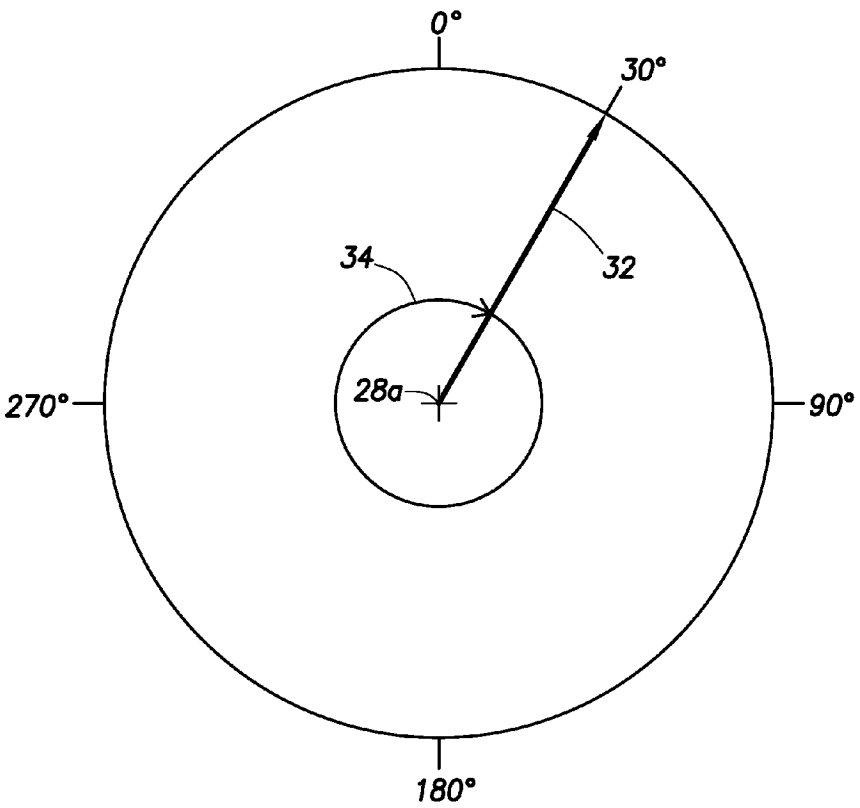
FIG. 3 is a schematic depiction of an azimuthal direction of a drill bit axis relative to a drill string axis.

Referring additionally now to FIG. 3, a schematic view of the relationship between the azimuthal direction of the drill bit 16 (represented by arrow 32 in FIG. 3) and the drill string axis 28*a* is representatively illustrated. That is, FIG. 3 presents a view downward along the axis 28*a* and, due to the angle A by which the drill bit axis 28*c* deviates from the drill string axis 28*a*, the drill bit 16 has an azimuthal direction 32 relative to the drill string axis 28*a*.

As the drill string 14 rotates, the azimuthal direction 32 of the drill bit axis 28*c* relative to the drill string axis 28*a* also rotates (as indicated by arrow 34 in FIG. 3). In one important feature of the system 10, the impact tool 22 delivers the impact 30 to the drill bit 16 when (and preferably only when) the azimuthal direction 32 of the drill bit axis 28*c* relative to the drill string axis 28*a* is in a desired direction.

For example, if it is desired to steer the drill bit 16 in an azimuthal direction of 30 degrees relative to the drill bit axis 28*a*, then the impact 30 would be delivered to the drill bit 16 when the drill bit axis 28*c* is oriented in an azimuthal direction 32 of 30 degrees relative to the drill string axis 28*a* (as depicted in FIG. 3). Since the azimuthal direction 32 of the drill bit axis 28*c* rotates about the drill bit axis 28*a* (as represented by arrow 34 in FIG. 3) as the drill string 14 rotates, the azimuthal direction of the drill bit axis will coincide with the desired azimuthal direction once for every rotation of the drill string 14.

Preferably, the impact tool 22 delivers the impact 30 to the drill bit 16 once for each rotation of the drill string 14 (when the azimuthal direction 32 of the drill bit axis 28*c* is oriented toward the desired direction), but the impact could be delivered every other rotation, every third rotation, multiple times per rotation, or at other times, in keeping with the principles of this disclosure.

The controller 24 controls the timing of the impact 30, based on the detection of the orientation of the drill bit axis 28*c* relative to the drill string axis 28*a* as sensed by the sensor assembly 26, and preferably based on commands, data, instructions, etc. received from a remote location (such as the surface) via telemetry. Any form of telemetry may be used, for example, wired or wireless telemetry. Wireless telemetry may include acoustic, electromagnetic, pressure pulse (positive and/or negative), pipe manipulation, etc. Wired telemetry may be via conductors internal to, external to, or in a wall of the drill string 14, etc.

The controller 24 may be used to activate or deactivate the impact tool 22 (e.g., to cause the impact tool to begin or cease delivering the impact 30 to the drill bit 16), to change the frequency of the impact (e.g., the number of impacts per rotation of the drill string 14), to change the desired azimuthal direction for steering the drill bit, to change the impact force delivered, etc. Any parameter related to the delivery of the impact 30 by the impact tool 22 may be controlled using the controller 24, in keeping with the principles of this disclosure.

Referring additionally now to FIGS. 4-7, various configurations of the impact tool 22 are schematically and representatively illustrated. However, it should be clearly understood that these examples of configurations of the impact tool 22 are not to be taken as limiting the principles of this disclosure to the depicted examples. Instead, the examples depicted in FIGS. 4-7 are intended to demonstrate that a wide variety of impact tool configurations are possible in keeping with the principles of this disclosure.

Figure 4:
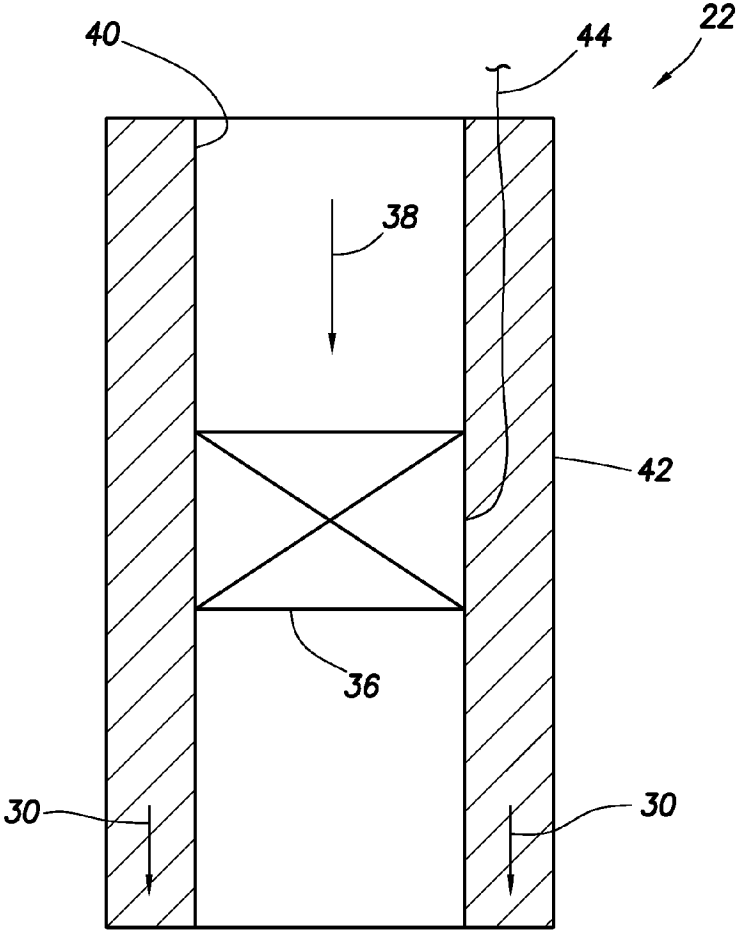

In FIG. 4, the impact tool 22 is depicted in a configuration in which a valve or other flow restricting device 36 is used to periodically close off or restrict flow of the drilling fluid 38 through a passage extending longitudinally through the impact tool. When the flow of the drilling fluid 38 is restricted by the device 36, the momentum of the fluid is converted to a force transmitted as the impact 30 through an outer housing 42 of the impact tool 22.

The device 36 could be provided as a spool valve, rotary valve, poppet valve or any other type of valve. However, it is not necessary for flow of the fluid 38 to be entirely prevented in order for the impact 30 to be generated, since a sufficient change in momentum of the fluid through the passage 40 could result from substantially restricting (rather than entirely preventing) the flow of the fluid.

Operation of the device 36 (for example, the timing of the restriction to flow of the fluid 38 through the passage 40) is controlled by the controller 24, as described above. Lines 44 are depicted in FIG. 4 for connecting the device 36 to the controller 24, but it should be understood that the controller could control operation of the device mechanically, hydraulically, electrically, optically, or in any other manner, in keeping with the principles of this disclosure.

Figure 5:
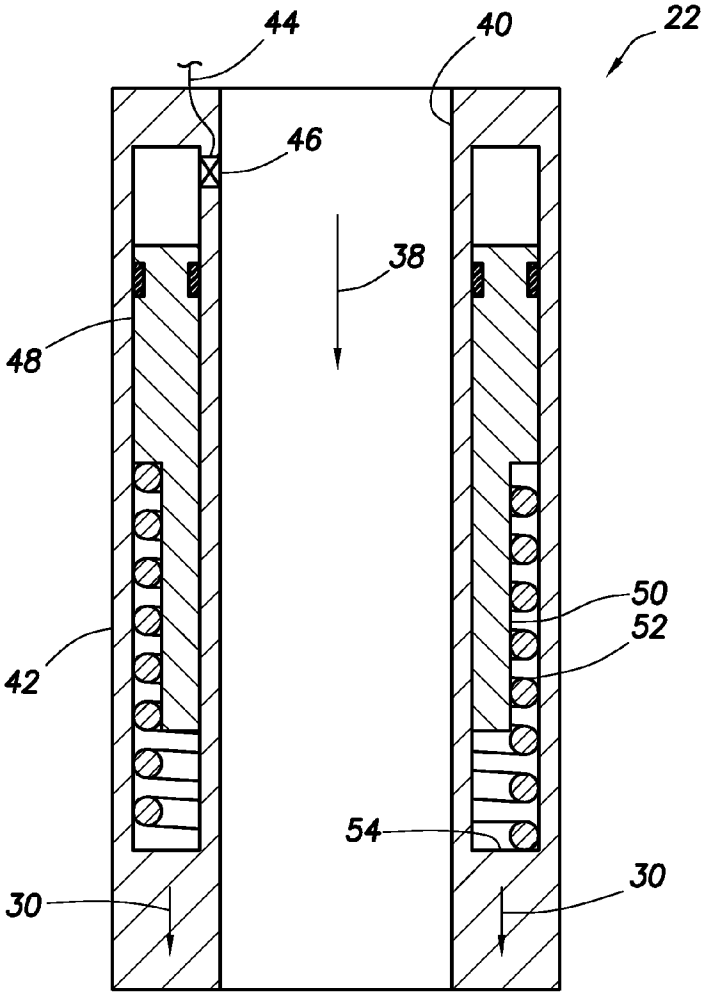
FIGS. 4-7 are schematic cross-sectional views of various configurations of an impact tool which may be used in the system and method of FIG. 1.

In FIG. 5, the impact tool 22 is depicted as including a valve 46, a piston 48, a mass 50, a biasing device 52 and a shoulder 54. When the impact 30 is to be delivered to the drill bit 16, the valve 46 is opened, thereby exposing the piston 48 to fluid pressure in the passage 40, and the piston displaces the mass 50 into contact with the shoulder 54. The timing of the opening of the valve 46 is controlled by the controller 24, as described above.

Figure 6:
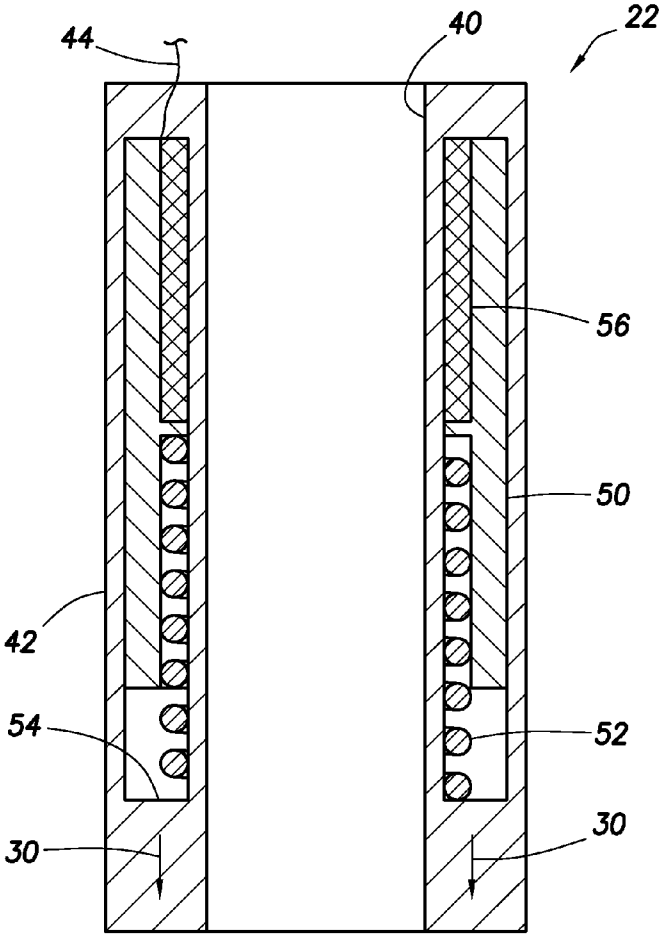

In FIG. 6, the impact tool 22 is depicted as including a solenoid 56 which is used to displace the mass 50 into contact with the shoulder 54 to thereby produce the impact 30. The timing of energizing the solenoid 56 is controlled by the controller 24, as described above.

Figure 7:
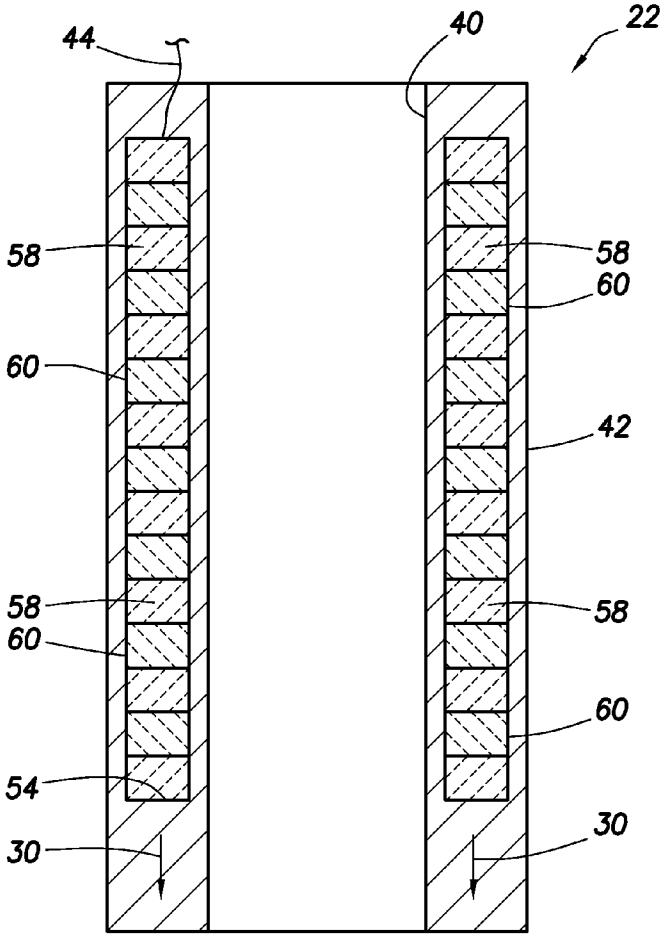

In FIG. 7, the impact tool 22 is depicted as including a piezoelectric material 58 in the form of a stack of annular disks 60. When an electrical potential is applied across the piezoelectric material 58, the material distorts and thereby produces the impact 30. The timing of applying the electrical potential across the piezoelectric material 58 is controlled by the controller 24, as described above.

Although the mud motor 18, bend 20, impact tool 22, controller 24 and sensor assembly 26 are separately described above, any of these elements could be combined with any of the other elements, as desired. For example, the mud motor 18 could be provided with the bend 20 as a single assembly, the impact tool 22 and controller 24 could be provided as a single assembly, the mud motor 18 can be provided with the sensor assembly 26 for detecting when the drill bit axis 28*c* is pointing in the desired azimuthal direction relative to the drill string axis 28*a*, etc.

The mud motor 18 in conjunction with the bend 20 may be used for directional drilling when the drill string 14 is not being rotated, which is known to those skilled in the art as directional drilling in sliding mode. Thus, although the mud motor 18 is not necessary for directional drilling when the drill string 14 is being rotated and the impact tool 22 is being used to deliver the impact 30 to the drill bit 16, its presence in the drill string is useful in that it provides the capability of directional drilling in sliding mode, if desired.

It may now be fully appreciated that the above disclosure provides several advancements to the art of steering a drill bit and directional drilling of a wellbore. In particular, the drill bit 16 can be steered while rotating the drill string 14 by delivering an impact 30 to the drill bit when an azimuthal direction 32 of its axis 28*c* is in a desired direction relative to an axis 28*a* of the drill string. The impact 30 being delivered to the drill bit 16 when its axis 28*c* is oriented in the desired azimuthal direction 32 causes the wellbore 12 to be preferentially drilled in the desired direction.

The above disclosure provides to the art a method of steering a drill bit 16 while drilling a wellbore 12. The method can include periodically delivering an impact 30 to the drill bit 16 as the drill bit is rotated by a drill string 14, and the impact 30 being delivered to the drill bit 16 when an axis 28*c* of the drill bit is oriented in a desired azimuthal direction 32 relative to an axis 28*a* of the drill string 14.

The impact 30 can be directed along the drill string axis 28*a* and along the drill bit axis 28*c*.

The drill bit axis 28*c* preferably rotates about the drill string axis 28*a* while the impact 30 is delivered to the drill bit 16.

The impact 30 may be delivered to the drill bit 16 only when the drill bit axis 28*c* is oriented in the desired azimuthal direction 32 relative to the drill string axis 28*a*.

A bend 20 may be interconnected between the drill bit 16 and an impact tool 22 which produces the impact 30. A mud motor 18 may be interconnected between the impact tool 22 and the bend 20.

Periodically delivering the impact 30 to the drill bit 16 can be performed by, for example, periodically restricting flow of fluid 38 through the drill string 14, periodically displacing a mass 50 with a piston 48, periodically displacing a mass 50 by energizing a solenoid 56, or periodically energizing a piezoelectric material 58.

Periodically delivering the impact 30 to the drill bit 16 may include detecting the azimuthal direction 32 of the drill bit axis 28*c* relative to the drill string axis 28*a* utilizing a sensor assembly 26 interconnected in the drill string 14.

The method can include changing the desired azimuthal direction 32 of the drill bit axis 28*c* from a remote location. Changing the desired azimuthal direction 32 may be performed in part by transmitting a command from the remote location via a telemetry signal.

Also provided by the above disclosure is a method of steering a drill bit 16 while drilling a wellbore 12, which method can include: interconnecting a bend 20 in a drill string 14 between an impact tool 22 and the drill bit 16, and periodically delivering an impact 30 from the impact tool 22 to the drill bit 16 as the drill bit is rotated by the drill string 14.

A directional drilling system 10 is also described above. The system 10 can include a drill string 14 having a bend 20 interconnected therein, an impact tool 22, and a drill bit 16. The bend 20 is preferably interconnected in the drill string 14 between the drill bit 16 and the impact tool 22.

The impact tool 22 can deliver an impact 30 to the drill bit 16, with the impact 30 being directed along an axis 28*c* of the drill bit 16. The impact tool 22 may deliver the impact 30 to the drill bit 16 when an axis 28*c* of the drill bit 16 is oriented in a desired azimuthal direction 32 relative to an axis 28*a* of the drill string 14 above the bend 20.

A sensor assembly 26 interconnected in the drill string 14 may sense an azimuthal direction 32 of an axis 28*c* of the drill bit 16 relative to an axis 28*a* of the drill string 14. A controller 24 may cause the impact tool 22 to deliver an impact 30 to the drill bit 16 in response to the azimuthal direction 32 of the drill bit axis 28*c* being at a desired azimuthal direction. The desired azimuthal direction 32 may be changed from a remote location.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of steering a drill bit of a drill string while drilling a wellbore, the method comprising:

rotating the drill string, wherein a longitudinal axis of the drill bit is angularly offset from a longitudinal axis of the drill string by a bend;

delivering, using an impact tool in the wellbore, a single impact for each azimuthal rotation of the drill bit about the longitudinal axis of the drill string, the impact being directed along both the longitudinal axis of the drill string and the longitudinal axis of the drill bit when the longitudinal axis of the drill bit is oriented in a desired azimuthal direction relative to the longitudinal axis of the drill string so as to direct the drill bit in the desired azimuthal direction due to the drill bit being angularly offset from the drill string;

stopping the rotation of the drill string when the longitudinal axis of the drill bit is oriented in the desired azimuthal direction and after at least one impact is delivered using the impact tool;

rotating the drill bit about its longitudinal axis using a mud motor;

sliding the drill string when the drill string is not being rotated; and wherein the bend is interconnected between the drill bit and the impact tool and between the mud motor and the drill bit.

2. The method of claim 1, further comprising: delivering an impact using the impact tool in the desired azimuthal direction when the drill string is not being rotated.

3. The method of claim 1, wherein the delivering further comprises permitting fluid flow from an internal flow passage of the impact tool into an exterior of the impact tool.

4. The method of claim 1, wherein the delivering further comprises displacing a mass which is disposed between an internal flow passage of the impact tool and an exterior of the impact tool.

5. The method of claim 4, wherein the delivering further comprises displacing the mass by energizing a solenoid.

6. The method of claim 1, further comprising changing the desired azimuthal direction of the longitudinal axis of the drill bit from a remote location.

7. The method of claim 6, wherein the changing is performed in part by transmitting a command from the remote location via a telemetry signal.

8. A method of steering a drill bit of a drill string while drilling a wellbore, the method comprising:

rotating the drill string, wherein a longitudinal axis of the drill bit is angularly offset from a longitudinal axis of the drill string by a bend;

delivering, using an impact tool in the wellbore, a single impact for each azimuthal rotation of the drill bit about the longitudinal axis of the drill string, the impact being delivered along both the longitudinal axis of the drill string and the longitudinal axis of the drill bit when the longitudinal axis of the drill bit is oriented in a desired azimuthal direction relative to the longitudinal axis of the drill string so as to direct the drill bit in the desired azimuthal direction due to the drill bit being angularly offset from the drill string, wherein the longitudinal axis of the drill bit is longitudinally offset from the longitudinal axis of the drill string, wherein the impact is produced by energizing a piezoelectric material;

stopping the rotation of the drill string when the longitudinal axis of the drill bit is oriented in the desired azimuthal direction and after at least one impact is delivered using the impact tool;

rotating the drill bit about its longitudinal axis using a mud motor;

sliding the drill string when the drill string is not being rotated; and wherein the bend is interconnected between the drill bit and the impact tool and between the mud motor and the drill bit.

9. The method of claim 1, wherein the delivering further comprises detecting the desired azimuthal direction of the longitudinal axis of the drill bit relative to the longitudinal axis of the drill string utilizing a sensor assembly.

10. A method of steering a drill bit of a drill string while drilling a wellbore, the method comprising:

interconnecting a bend between an impact tool and the drill bit, wherein a longitudinal axis of the drill bit is angularly offset from a longitudinal axis of the drill string by the bend;

interconnecting a mud motor such that the bend is between the mud motor and the drill bit;

rotating the drill bit about its longitudinal axis using the mud motor;

sliding the drill string when the longitudinal axis of the drill bit is oriented in the desired azimuthal direction and the drill string is not being rotated;

rotating the drill string after in the drill string; and during steering of the drill bit, for each azimuthal rotation of the drill bit about the longitudinal axis of the drill string, delivering a single impact using the impact tool in the wellbore when the longitudinal axis of the drill bit is oriented in the desired azimuthal direction relative to the longitudinal axis of the drill string.

11. The method of claim 10, further comprising changing the desired azimuthal direction of the longitudinal axis of the drill bit from a remote location.

12. The method of claim 11, wherein the changing is performed in part by transmitting a command from the remote location via a telemetry signal.

13. The method of claim 10, wherein the impact is directed along the longitudinal axis of the drill string and along the longitudinal axis of the drill bit.

14. The method of claim 10, wherein the delivering further comprises displacing a mass which is reciprocally disposed within a wall of an outer housing of the impact tool.

15. The method of claim 14, wherein the mass comprises a piston.

16. The method of claim 14, wherein the delivering further comprises displacing the mass by energizing a solenoid.

17. The method of claim 10, wherein the impact is delivered to the drill bit only when the longitudinal axis of the drill bit is oriented in the desired azimuthal direction relative to the longitudinal axis of the drill string.

18. The method of claim 10, wherein the delivering further comprises permitting fluid flow from an internal flow passage into an outer housing of the impact tool.

19. The method of claim 10, wherein the delivering further comprises detecting the desired azimuthal direction of the longitudinal axis of the drill bit relative to the longitudinal axis of the drill string utilizing a sensor assembly interconnected in the drill string.

20. A directional drilling system, comprising:

a drill string;

an impact tool interconnected in the drill string and comprising a wall disposed between an internal flow passage of the impact tool and an exterior of the impact tool;

a bend interconnected in the drill string between a drill bit and the impact tool;

a reciprocating mass disposed within the impact tool wall, wherein a single impact is delivered to a drill bit in response to displacement of the reciprocating mass;

a drill motor interconnected such that the bend is interconnected between the drill motor and the drill bit, wherein the drill motor is configured to rotate the drill bit about a longitudinal axis of the drill bit whether or not the drill string is being rotated, wherein the longitudinal axis of the drill bit is angularly offset from a longitudinal axis of the drill string by the bend;

a controller configured to steer the drill bit using the impact tool; and wherein the impact tool is configured to deliver the impact to the drill bit in response to the longitudinal axis of the drill bit being at a desired azimuthal direction relative to the longitudinal axis of the drill string whether or not the drill string is being rotated.

21. The system of claim 20, wherein the impact is directed along the longitudinal axis of the drill bit.

22. The system of claim 20, wherein a sensor assembly interconnected in the drill string is configured to sense the desired azimuthal direction of the longitudinal axis of the drill bit relative to the longitudinal axis of the drill string.

23. The system of claim 20, wherein the controller is configured to cause the impact tool to deliver the impact to the drill bit.

24. The system of claim 20, wherein the desired azimuthal direction is changeable from a remote location.

25. The system of claim 20, wherein the impact tool is configured to deliver the impact for each azimuthal rotation of the drill bit.

* * * * *